United States Patent [19]

Newcomb

[11] 4,347,631

[45] Sep. 7, 1982

[54] EAR MUFF ACCESSORY FOR SAFETY HARD HAT

[75] Inventor: William E. Newcomb, Coventry, R.I.

[73] Assignee: Norton Company, Worcester, Mass.

[21] Appl. No.: 170,193

[22] Filed: Jul. 18, 1980

[51] Int. Cl.[3] ..... A42B 1/24

[52] U.S. Cl. ..... 2/423; 2/209; 179/156 R

[58] Field of Search ..... 2/423, 209, 6, 10; 179/156 R

[56] References Cited

U.S. PATENT DOCUMENTS

| | | | |
|---|---|---|---|
| D. 244,491 | 5/1977 | Csiki et al. | D2/232 |
| D. 248,191 | 6/1978 | Csiki et al. | D2/232 |
| 3,400,406 | 9/1968 | Aileo | 2/6 |
| 3,430,261 | 3/1969 | Benner | 3/423 |
| 3,721,993 | 3/1973 | Lonnstedt | 2/209 X |
| 3,795,919 | 3/1974 | Aho | 2/6 |
| 4,069,512 | 1/1978 | Palmaer | 2/209 |
| 4,104,743 | 8/1978 | Bottger | 2/423 |

*Primary Examiner*—Peter P. Nerbun
*Attorney, Agent, or Firm*—Walter Fred

[57] ABSTRACT

A device (10) is disclosed for mounting a hearing protector (90) on each side of a hard hat, pressing the hearing protectors at a substantially constant force about the ears and moving them in oppositely incline planes between an operative wearing position (W) and an extended inoperative pressure relieved stored position (R). Each device comprises support means (20) including a pivot (28) adapted for attachment to and retained to a side of the hard hat (H), by retainer means (30), guide means (40) (50) including at least one incline surface (44) (54) and a key boss (46) (56) projecting into a key hole shape slot (74) in a rigid central end portion (72) of a resilient flexible support arm (70) secured by releasable clamping means (60). When positioned in the elongated part of the key hole slot, the key boss allows limited vertical and angular adjustments of the support arm (70) and unrestricted rotation between operative and inoperative positions can occur only when the support arm is fully extended and an enlarged circular end portion of the key hole slot is aligned with the axis of the pivot stud and key boss of smaller diameter. Thus, at any given degree of flexure the support arm exerts a substantially constant resilient force and extending and rotation of the support arm along the incline plane to the inoperative stored position shifts the arm and protector outwardly from any substantially pressure contact with the side of the hat to allow the arm and protector to recover and return to an unflexed natural state.

9 Claims, 7 Drawing Figures

1/1

EAR MUFF ACCESSORY FOR SAFETY HARD HAT

TECHNICAL FIELD

The invention relates to mounting of ear protective devices and particularly to an improved adjustable device for mounting a pair of ear mufflers on a safety hard hat for pivotal movement in opposite inclined planes between a stressed constant pressure ear engaging wearing position to an extended upper non-stressed rest or stored position and resiliently pressing the mufflers at a substantially constant pressure about the ears of an individual.

BACKGROUND ART

The prior art discloses a number of adjustable devices for attaching noise suppressing ear mufflers to hard hats, varying the sealing pressure engagement thereof against the ears, disengaging and shifting the mufflers from the ears to a rest or stored position. However, the ear mufflers are adjustably or non adjustably mounted on adjustable flexible spring levers or support arms rotatably mounted on the hard hat for movement in vertical parallel planes. Hence, in the rest position the resilient lever support arms remain flexed or stressed and continue to press the ear mufflers against the side or crown of the hard hat.

Further, adjusting the spring lever or flexible support arm relative to its supporting bracket or the muffler relative to the arm varies the effective length and hence the pressure exerted by the arm against the mufflers and the engaging ear.

The applicants device is an improvement on a similar device disclosed in a pending application of another inventor and assigned to the same assignee. The improved device differs from the known prior art in that the support arm has limited vertical and angular adjustment in the wearing position and must be extended before it can be rotated to an assured non-flexed stored position. Further, each resilient support arm has a fixed point of pivotal connection with the muffler, begins to flex about the same point relative thereto and applies a substantially constant pressure regardless of the adjusted position relative to support bracket. Additionally, the support bracket attached to the hard hat is provided with means for directing the rotatable support arms and attached mufflers away from the crown of hard hat and thereby allowing the resilient lever arm to return to its initial unstressed and non flexed state.

Also, it is highly desirable that the hard hats and accessories attached thereto be made of non conductive dielectric materials such as plastics.

However, plastics including other material maintained under extended period of tension have a tendency to creep, lose some of their resiliency and the ability to fully recover and return to the initial state.

Therefor, it is desirable to relieve tension in the resilient muffler support arm when the ear mufflers are rotated to an inoperative or stored position, and thereby retain a substantially constant sufficient amount of resiliency and pressure exerted thereby to seal the mufflers about the ears.

DISCLOSURE OF THE INVENTION

A safety helmet or hard hat is provided with a pair of noise suppressing ear muff accessories mounted thereon for rotative movement in oppositely inclined planes about axes of supporting pivot studs projecting from support brackets or adaptors attached to opposite sides of the hard hat.

The pivot stud support brackets have tabs or tongues inserted into slotted side portions or side pockets extending upwardly from lower surfaces of the rim or rain gutter on the hard hat. A pair of stationary retainers extend over the pivot studs into clamping engagement with the support brackets and under the rim of the hard hat to prevent removal from the side pockets.

Either the retainers or additional inner stationary tapered washers keyed to the pivot studs have annular inclined surfaces engagable with the inner sides of relatively rigid elongated slotted upper central portions of a pair of flexible resilient ear muff support arms with key hole shape slots.

A second pair of tapered outer washers also keyed, against rotation, to the pivot studs have inclined surfaces engaging the opposite outer side of the slotted central portions of the support arms.

Key bosses of greater diameter than width project from the tapered washers and into an elongated portion of the key hole slot to allow limited vertical and angular adjustments of the support arm in the wearing position. Rotation to and from the storing position occurs only when the support arm is fully extended and the key bosses are within the larger enlarged end portion of the key hole slot.

A pair of clamping nuts are screw threaded onto the ends of the pivot studs for adjusting and clamping the upper central portions of the resilient support arm in the desired adjusted position between the parallel inclined surfaces.

Each support arm comprises at least one but preferably a pair of resilient flexible side legs attached to and extending downwardly from upper opposite sides of the substantially rigid key hole slotted central portion to opposing pivot pins at the lower ends thereof for pivotally supporting an ear muff therebetween. The spaced flexible side legs are connected by an intermediate cross bar and flex at substantially the same radial point and distance from the pivot pin axis regardless of the adjusted vertical position of the support arm. Hence, the ear muff support arms apply a substantially constant pressure to the ear muffs and area about the ear when flexed outwardly the same distance from its initial relaxed unstressed position.

Loosening of the clamp nuts allows each support arm and attached muff to be extended to a fully rotatable position, flexed outwardly to clear the lower rim, rotated about the key bosses and pivot stud, and simultaneously shifted outwardly by the inclined guide channel surfaces to a storing position above the rim, released to an unflexed state of rest adjacent a side of the hard hat and reclamped.

BEST MODE FOR CARRYING OUT THE INVENTION

Figures 1, 2, 3, 4, 5, 6, 7:
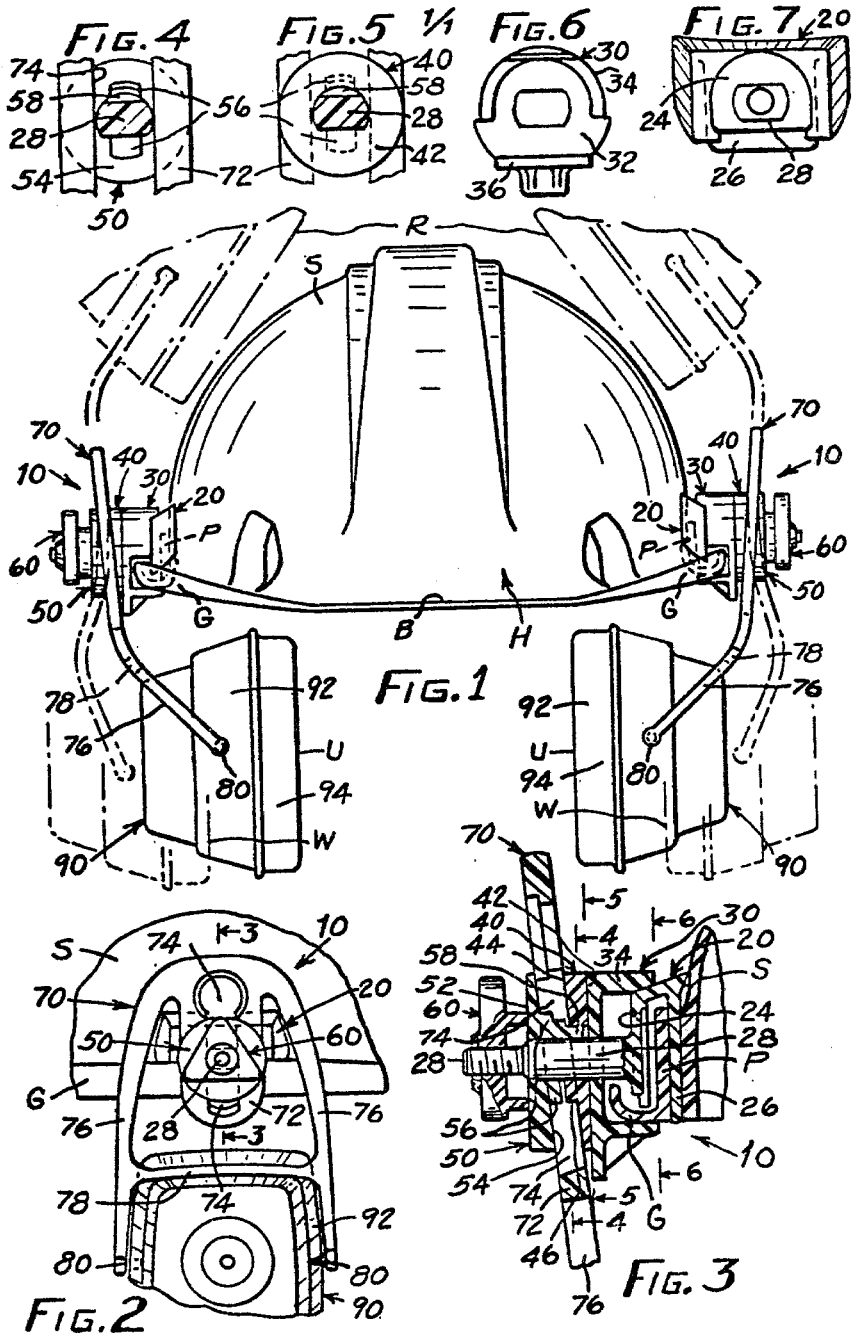
FIG. 1 is a front view of a safety hard hat and a pair of substantially constant pressure noise suppressing ear protective accessories mounted thereon for movement in oppositely inclined planes according to the invention.
FIG. 2 is a side view of one of the pair of ear protective accessories of FIG. 1.
FIG. 3 is a cross section view taken along line 3—3 of FIG. 2 through the various components supporting the ear protective accessory.
FIG. 4 is a cross sectional view taken along line 4—4 of FIG. 3 showing the pivot stud and key bosses situated within an elongated part of a key hole shape slot in the support arm and the inner central surface of the outer tapered washer.
FIG. 5 is a cross sectional view taken along line 5—5 of FIG. 3 through the pivot stud and the inner side of the inner tapered washer.
FIG. 6 is an opposite inner side view along line 6—6 of FIG. 3 of the pivot stud support bracket retainer with a lower portion or flange extending under the rim of the hard hat.
FIG. 7 is an outer side view of the pivot stud support bracket mounted in the slotted side portions or side pockets of the hard hat.

Referring to FIGS. 1-3, a safety helmet or hard hat H comprises a head protective crown or shell S extending upwardly from a lower rim or rain gutter G extending around the lower rear and opposite side portions to a brim B at the front of the hard hat H.

A pair of side pockets or slotted portions P are provided on opposite sides of the shell substantially at an intermediate position adjacent and above the ears of the wearer of the hard hat. The side pockets project upwardly from the gutter G and a relatively short distance outwardly from the shell into a portion of the rain gutter G.

The side pockets P have elongated slots therein for attaching and supporting a pair of substantially identical noise suppressing or hearing protective accessories 10 for movement in oppositely inclined planes between operative wearing and inoperative storing or rest positions.

Each hearing protector accessory 10 comprises a pivot stud support or bracket 20 adapted for attachment to a side of the hard hat. Preferably, the brackets are inserted in side pockets P and project horizontally outwardly from each side of the shell.

The support brackets 20 each have a generally rectangular hollow end portion or end housing 24 including an outer vertical side wall and outer inclined peripheral wall with a narrow peripheral edge or end surface that conforms to the curvature of and supportingly engages the side wall of the shell S about the side pocket P. An enlongated tab or tongue 26 extends about 1" (2.54 cm) internally of and downwardly from the upper inclined wall of the end housing 24 and is inserted into the slot in the side pocket P. The outer wall of the end housing 24 is spaced from the tongue 26 and outer wall of the side pocket P, extends downwardly to a lower edge spaced above the bottom of the gutter G and supports a pivot stud or portion 28 extending outwardly about 1 1/16" (26.98 mm) therefrom to the outer end of a screw threaded end portion thereof about 7/16" (11.11 mm) long and ¼" (6.349 mm) in diameter.

In cross section the pivot stud portion 28 has, as shown in FIG. 4 and 5, a generally rectangular non-cylindrical key like configuration defined by opposite straight or flat surfaces extending between and connected to the ends of opposing curved or arcuate surfaces about 7/16" (11.11 mm) in diameter extending axially about ⅝" (15.87 mm) to the threaded end portion thereof.

Means are provided for retaining the pivot support brackets 20 in the side pockets P. The retaining means comprises a non-rotatable or stationary hollow retainer 30 including an outer side wall 32 with a central aperture of substantially the cross sectional size and shape of the portion of the pivot stud 28 passing therethrough and thereby keyed thereto.

The retainer 30 has a central recess about which extends a partly circular or semi circular wall 34 about 1¼" (3.17 cm) in diameter projecting about 5/16" (7.9 mm) from the outer side wall 32 to end surfaces engaging the outer vertical wall of the end housing 24 and a central upper top portion including an internal inclined surface projecting over the outer top inclined wall of the end housing 24. At its opposite bottom side the retainer 30 has a gusset reinforced lower flange or wall portion 36 projecting from the side wall 32 and under the rim or gutter G of the hard hat H to hold bracket 20 in place.

Mounted on and keyed to the pivot stud 28 adjacent the retainer 30 are guide means comprising a non rotatable or stationary inner tapered washer 40 about 1¼" (3.17 cm) in diameter. The washer 40 comprises an inner surface 42 engaging the wall 32 of retainer 30, an opposite outer inclined cam surface 44 situated at angle of from about 5° to 10°, preferably about 5°, from a plane normal to the axis of the pivot stud 28 passing through a central aperture of similar configuration therein.

The configuration of the central aperture in washer 40 is more than semi circular, less than a full circle and about ¾ of a complete circle defined by an internal straight side or surface extending between ends of the ¾ round or circular internal surface of the washer 40.

Adjoining and extending downwardly from the lower internal straight surface of the ¾ round aperture of washer 40 is a key like projection or boss 46 of narrower width than the pivot stud extending downwardly to a lower arcuate surface thereof of larger radius than that of the pivot stud 28.

The narrow key or boss 46 extends outwardly from the inclined surface and into an elongated part of a key hole shape slot of slightly greater width that the diameter of the pivot stud in a central rigid portion of a resilient flexible ear muff support arm 70 described hereinafter.

Alternatively, the separate tapered washer 40 may be made as an integral part of the retainer 30 by fixing thereto or axially thickening and providing the wall 32 of the retainer 30 with the inclined surface 44, the boss 46 and the ¾ round aperture.

The guide means mounted on and keyed to the pivot stud 28 further comprises an outer tapered washer 50 including an outer surface 52, an inner inclined cam surface 54, with a narrow key like boss 56 projecting therefrom and a central aperture of the same cross sectional shape as the pivot stud 28 passing therethrough. Washer 50 being of substantially the same diameter as washer 40.

Similarly, the key 56 has opposite top and bottom arcuate surfaces with a radius and a width substantially equal to those of the opposing boss 46.

The key 56 extends transversely of the axis from opposite top and bottom flat sides of the central apertures, axially from the inclined surface 54 and into the elongated slot in the support arm 70 toward the inclined surface 44 and boss 46 of washer 40.

The outer tapered washer 50 also has an interlocking portion 58 of about one quarter (¼) round or circular shape extending axially from the upper portion of key 56 and into the upper quarter (¼) round or circular portion of the ¾ round or circular aperture in the tapered washer 40.

The quarter round interlocking and interfitting portion 58 has an arcuate surface adjacent the arcuate surface of the washer 40 and a flat, straight or chord like surface adjacent the upper flat surface of the pivot stud 28 which together maintain the angular alignment of the washers 40 and 50 and hence the axially spaced inclined surfaces 44 and 54 substantially parallel to one another.

A triangular or polygonal shape clamping nut 60 is provided for manually unclamping, adjusting and clamping the various elements of the accessory 10 together in the adjusted or desired positions.

Each ear muff or noise suppressing hearing accessory comprises a resilient flexible support arm 70 at a supporting end portion of which is a relatively rigid leaf like intermediate or central slotted portion 72 of substantially uniform thickness. The central portion 72 has a key hole shape elongated slot 74 about 2" (5.08 cm) long enlarged at its upper end and adjustably clamped between the inclined guiding and clamping surfaces 44 and 54 of the tapered washers 40 and 50. The width of the elongated narrow portion of the key hole slot 74 is slightly greater or no smaller than the diameter of pivot stud 28 and less than the diameter of key bosses 46 and 56 of smaller diameter than the enlarged end portion of the key hole slot.

The intermediate portion 72 has a lower free end portion and an upper end portion integrally connected to and supporting a spaced pair of identical flexible reilient arms or legs 76 connected by an intermediate cross bar or member 78. In the unflexed state shown in FIG. 1 the legs 76 have straight upper inclined portions extending downwardly and inwardly to intermediate inwardly curved bends or portions from which lower straight inclined portions extend downwardly and further inwardly to opposite lower ends thereof spaced about $2\frac{3}{4}$" (6.98 cm) apart and supporting axially aligned pivot pin 80 pivotally connected to ear muffs 90. The lower inwardly inclined portions of the flexible legs 76 are initially spread apart, the pivot pins 80 aligned with and resiliently released into pivot pin receiving apertures in opposite sides of the casing 92 of the ear muffs or hearing protectors 90.

Preferably each support arm 70 has a substantially uniform thickness of about 3/16" (4.7 mm), a length of about 5" (12.7 cm) measured along a plane between its opposite ends, a maximum width of about $3\frac{1}{4}$" (8.25 cm) at the cross member 78 and about $3\frac{1}{8}$" (7.93 cm) at the pivot pin ends extending inwardly about $1\frac{3}{4}$" (4.44 cm) from the plane of the opposite supporting end and central portion 72 about $1\frac{1}{4}$" (3.17 cm) wide by $2\frac{3}{4}$" (6.98 cm) long. Also the flexible legs 76 diverge from an arcuately shaped supporting end portion of arm 70 with a chord dimension of approximately $1\frac{3}{4}$" (4.44 cm) to the cross member 78.

As shown in FIGS. 1 and 3 the flexible legs 76 are of substantially uniform thickness along the inwardly extending direction of flexure and in the other direction 90° therefrom they taper from upper portions of greater width at junctions with the rigid slotted portion 72 to narrower lower pivot ends thereof as shown in FIG. 2. Hence, the legs 76 have a greater tendency to bend or flex sidewardly and outwardly from substantially the portions adjoining the junctions with the central rigid portion 72 and apply a substantially non adjustable constant resilient pressure to the hearing protectors 90 placed about ears of the same individual to which they are adjusted.

Obviously, the distance between ears and opposite sides of the head of different individuals vary and hence the pressure applied by the resilient flexible legs will vary according to how much the legs are flexed outwardly.

However, the minimum amount of resilient pressure applied is calculated to provide a sufficient sealing engagement between the soft flexible resilient liner or cup 94 attached to the casing 92 of each hearing protector 90 and areas adjacent the ears of persons of less than average width therebetween. Various positions which the hearing protector may assume are shown in FIG. 1. Normally in use the support arms 70 and hearing protector 90 never assume the inner most unflexed non wearing inoperative position U shown in full lines but are manually displaced and flexed outwardly therefrom to one of a number of wearing positions, one of which is indicated at W, and released against areas about the ears.

When displaced to the extreme wearing position W shown the legs 76 of the support arms 70 flex or bend to the extreme reverse curvature or configuration shown in phantom lines about an upper portion adjoining the central rigid portion 72 clamped between the tapered washers 40 and 50.

Obviously, the degree of flexure or bending and curvature of the legs and the resilient pressure applied thereby will decrease as muff 90 assumes wearing position closer to the position U and more inwardly of the wearing position W as shown.

Each of the resilient support arms 70 is adjustable both along an incline plane of the washer 40 and 50 and a limited angular amount relative to the axis of the pivot stud 28 and about opposite arcuate surfaces thereof engaging opposite sides of the slot 74.

Loosening the nut 60 and hence the clamping pressure of tapered washers 40 and 50 the support arm 70 may be adjusted upwardly or downwardly and pivoted either rearwardly or forwardly to align the hearing protector muff 90 with the adjacent ear and reclamped in the desired position.

The amount of angular or pivoted movement of arms 70 is limited by contact with the opposite end portions of the narrower keys or bosses 46 and 56 projecting from the washers 40 and 50 into the slot 74 of relative greater width in the rigid portion 72.

It can be seen that adjusting the support arm 70 upwardly along the inclined surfaces relative to the axis of pivot stud 28 shifts the pivot pins 80 and attached muff 90 upwardly and outwardly in a parallel incline plane away from a more inward or the full line position U, as shown in FIG. 1. Conversely, moving the support arm 70 downwardly along the incline surfaces relative to the axis of the pivot stud 28 shifts the pivot pins 80 and muff 90 downwardly and inwardly in a parallel incline plane away from a more outward or the full line position U shown in FIG. 1.

Further, any flexing or side bending movement of support arms 70 toward and away from the full position U shown in FIG. 1 causes the pivot pins 80 and attached muff to move in a relatively short arc of substantially fixed radius of between 4 to 5" (10.1 to 12.7 cm) and thereby slightly vary the position of the pivot pin 80 axis and attached muff 90 relative to both the incline plane of washers 40 and 50 and axis of pivot stud 28.

Once the ear protector muff 90 and supporting arms 70 are adjusted to fit the head of a particular person, the tension or resilient pressure exerted by the support arms remain substantially constant and non-adjustable.

Manually operable means are provided to remove the muffs 90 from the wearing position and store them in an unflexed state and rest position R above the rim or gutter G at opposite side of the hard hat H. As shown in FIG. 1 by phanton lines, each muff 90 is moved by loosening lock nut 60, pulling muff 90 and support arm 70 downwardly until the upper enlarged clearance portion of the slot 74 is axially aligned with the axis of the pivot stud 28, flexed outwardly to clear the rim G and rotated about the key bosses 46 and 56 of washers 40 and 50 to the stored position R and re clamped by tightening nut 60.

It can be seen that during 180° rotary pivotal movement of the support arm 70 and attached muff 90 relative to the stationary spaced inclined surfaces of the tapered washers 40 and 50, the inclined guideway therebetween directs and causes the support arm 70 and muff 90 to move outwardly away from any substantial pressure contact with the side of the shell S of the hard hat.

Thus, the flexible resilient legs 76 of the support arms 70 and resilient liner 94 of the muff 90 are allowed to recover and assume a non-stressed unflexed state, to prevent the material from creeping and taking a set, maintaining resiliency and hence increasing the life thereof.

Preferably, the various components 20, 30, 40, 50, 60, 70, and 90, and of the hard hat H to which they attached are molded of a suitable dielectric plastic material. However, they may be molded, cast, fabricated or constructed of other suitable materials such as plastic, ceramic, metal, combinations thereof and fiber reinforced composites thereof.

The dielectric plastic is preferably selected from a group consisting of: nylon, polyacetal, and polycarbonate.

As many embodiments of the instant invention are possible. It is to be understood that the invention is not limited to the specific embodiment disclosed but includes all modifications and equivalents thereof falling within the scope of the appended claims.

I claim:

1. A device for mounting a hearing protector on each of the opposite sides of a safety hard hat for movement in oppositely inclined planes between an operative pressure applying wearing position about ears of an individual and an inoperative pressure relieved storing position above a lower rim of and adjacent opposite sides of the hard hat comprising:

a support having:

an end portion adapted for attachment to one of the opposite sides of the hard hat and a pivot stud extending axially outwardly from the end portion to an opposite outer fastener end portion thereof;

guide means fixed against rotation about the pivot stud and having:

an inclined surface extending inwardly at an angle from an upper outer point to a lower inner point situated closer to a central plane between opposite sides of the hard hat and a key boss projecting radially beyond opposite sides of the pivot stud and axially adjacent the inclined surface and having a width no greater than and a diameter greater than the pivot stud diameter;

a support arm mounted about the pivot stud adjacent the guide means for relative movement in an inclined plane between operative and inoperative positions, resiliently pressing and maintaining a hearing protector in engagement with an area about the ear and having:

a supporting end portion at one end thereof including:

a central portion engageable with the guide means and extending inwardly from an outer end of an opposite inner end thereof including a key hole shape slot into which extend the pivot stud and key boss adjustable relative thereto having:

an elongated slot portion of a width no less than the pivot stud diameter but less than the diameter of the key boss and an enlarged end portion adjacent the outer end of a diameter no less than the boss for receiving the boss and allowing unrestricted movement of the central portion and support arm about the boss between the operative and inoperative positions, and at least one flexible resilient leg connected to and extending from a junction with the central portion to an opposite free end thereof adapted for attaching a hearing protector thereto at a predetermined fixed distance from the junction and resiliently pressing a hearing protector at substantially constant force into engagement with areas about the ear of an individual and clamping means on the fastener end portion of the pivot stud for releasing and shifting the central portion and support arm to and from an extended rotatable position for movement about the key boss and sufficient guiding engagement with the inclined surface during movement between the operative and inoperative positions, and for adjusting and clamping the support arms and attached hearing protector in the operative and inoperative positions whereby the inclined surface of the guide means shifts and directs the extended support arm and attached hearing protector outwardly from an inner resilient pressure applying wearing position about the ear to a substantially pressureless stored position above the rim and adjacent side of the hard hat.

2. A device according to claim 1 wherein the guide means further comprises:

a second inclined surface engagable with an opposite side of the central portion and extending substantially parallel to the first mentioned inclined surface which together provide an inclined guide channel for guiding the support arm.

3. A device according to claim 2 wherein the guide means further comprises:

an inner tapered washer non rotatably keyed to the pivot stud including:

an aperture through which the pivot stud extends axially and the first mentioned inclined surface thereon, and an outer tapered washer non rotatably keyed to and axially movable relative to the pivot stud and the inner tapered washer including:

an aperture through which the pivot stud extends axially and the second inclined surface thereon.

4. A device according to claim 3 wherein at least one of the inner and outer tapered washers comprises:

a key boss extending axially from its inclined surface into the key hole shape slot in the support arm toward the inclined surface of the other tapered washer and having:

opposite arcuate surfaces of a diameter no greater than the diameter of the enlarged end portion but greater than the width of the elongated slot portion and a width less than the width of the elongated slot portion of key hole slot whereby the elongated slot portion allows limited angular movement between the support arm and the key boss and alignment of the key boss with the enlarged end portion allows unrestricted rotation of the support arm between the operative and inoperative portions.

5. A device according to claim 4 wherein the support further comprises:

an elongated portion extending from the end portion and adapted for insertion in a slot of a side pocket provided at each of the opposite sides and adjacent the lower rim of the hard hat.

6. A device according to claim 5 further comprising:

retaining means mounted on the pivot stud between the inner tapered washer and the end portion for engaging the lower rim and maintaining the support and elongated portion attached to the side pocket of the hard hat.

7. A device according to claim 6 wherein the clamping means comprises:

an adjustable nut threaded onto the fastener end portion of the pivot stud and manually adjustable by hand to release and clamp the central portion and support arm in the desired position.

8. A device according to claim 7 wherein one of the tapered washers further comprises:

an interlocking portion extending therefrom and projecting into a portion of the aperture in the other one of the tapered washers wherein the tapered washers are keyed together and to the pivot stud.

9. A device according to claim 1 further comprising:

retaining means adjoining and projecting axially from the incline surface of the guide means into engagement with the end portions of the support and under the rim of the hard hat for retaining the support attached to the side of the hard hat.

* * * * *